United States Patent [19]

Biedess

[11] Patent Number: 4,598,647

[45] Date of Patent: Jul. 8, 1986

[54] SHRAPNEL PROOF DOOR FRAME

[75] Inventor: Frederick F. Biedess, Oak Lawn, Ill.

[73] Assignee: National Bullet Proof, Inc., Hickory Hills, Ill.

[21] Appl. No.: 590,244

[22] Filed: Mar. 16, 1984

[51] Int. Cl.[4] ..... E06B 1/04

[52] U.S. Cl. ..... 109/77; 109/74; 109/26; 49/504

[58] Field of Search ..... 109/9, 26, 49.5, 58, 109/65, 74, 77, 79, 85; 49/504, 505

[56] References Cited

U.S. PATENT DOCUMENTS

| | | | |
|---|---|---|---|
| 1,054,325 | 2/1913 | Wege | 109/74 |
| 1,428,340 | 9/1922 | Meilink | 109/74 |
| 1,948,602 | 2/1934 | Tracy | 109/77 |
| 2,329,420 | 9/1943 | Sheehan et al. | 109/79 |

FOREIGN PATENT DOCUMENTS

| | | | |
|---|---|---|---|
| 1280532 | 10/1968 | Fed. Rep. of Germany | 49/505 |
| 2325921 | 12/1974 | Fed. Rep. of Germany | 109/49.5 |
| 2515663 | 10/1976 | Fed. Rep. of Germany | 49/505 |

*Primary Examiner*—Thomas J. Holko
*Assistant Examiner*—Neill Wilson
*Attorney, Agent, or Firm*—Bernard L. Kleinke

[57] ABSTRACT

A bulletproof door and door jamb construction includes a door jamb which includes a vertically and horizontally extending opening therein in an area where bullet shrapnel fragments can pass freely therethrough into the hollow interior of the door jamb so that the spent fragments lose their energy and do not enter the protected area behind the door by otherwise passing through the crack or space between the door and door jamb.

8 Claims, 3 Drawing Figures

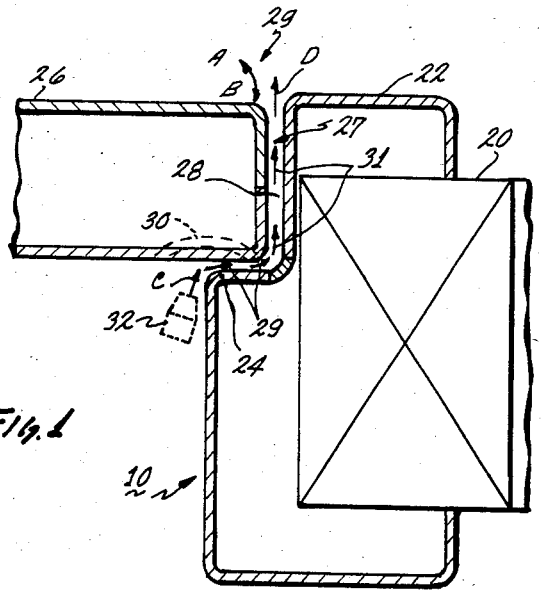
Fig. 1
Fig. 2
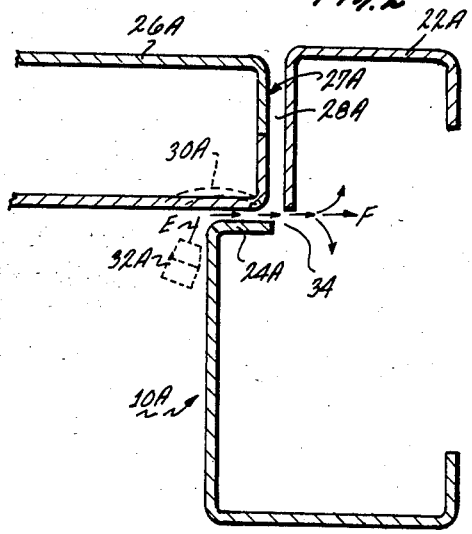
Fig. 3
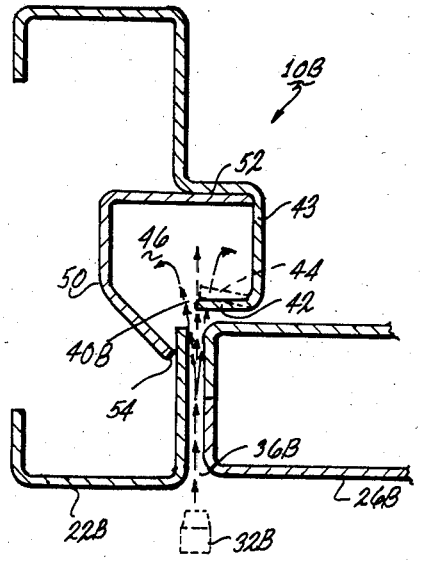

SHRAPNEL PROOF DOOR FRAME

TECHNICAL FIELD

This invention relates to bulletproof door frames, and it more particularly to door frames which resist shrapnel fragments.

BACKGROUND ART

Conventional, prior or known bulletproof door frames usually have a door jamb which includes a built-in door stop. The primary difference between a conventional and a bulletproof construction is in the material used to make the door. The material has a strength which is adequate to stop a particular type of bullet. Thus, different materials and gauges are selected to stop rifles, hand guns, "Saturday Night Specials", and the like. Thus, when a reference is hereinafter made to a bulletproof specification material, it means whatever particular material required to resist the type of bullet in question.

It has been found that if a bullet is directed toward the threat side of a door made of the bulletproof specification material, a dish shaped deformation is formed in the door at the point of impact, and the stopped bullet gives off fragments of shrapnel, which travel along the threat side of the door in a plane parallel thereto. The angle of incidence at which the bullet strikes the door does have some effect upon the angle at which the shrapnel fragments travel away from the door. However, in general, the effect is much less than would normally be expected.

But if the shrapnel fragments strike the door jamb at the crack or space between the door and door jamb, the fragments tend to act as if they were trapped in a guide, and thus they follow the crack and exit into the protected area on the opposite side of the door with enough energy to cause damage. In this regard, the fragments are oftentimes sufficiently small so as to pass freely through the crack or space between the door jamb and the door, thereby presenting a serious risk of injury to persons, or damage to property, located in the protected area on the opposite side of the door.

Thus, it would be highly desirable to have a new and improved bulletproof door and door jamb construction, which prevents, or at least greatly reduces, the possibility of shrapnel fragments traveling which high energy through the crack between the door and the door jamb and entering the protected area behind the door. In this regard, it would be of great importance to have such a new construction, which would not only tend to keep potentially dangerous bullet fragments from entering the protected area, but which would also be relatively inexpensive to manufacture and to install.

DISCLOSURE OF INVENTION

Accordingly, an object of the invention is provide new and improved bulletproof doors, and especially is to provide means and methods for containing fragments of bullets directed toward the threat side of such a door.

In particular, an object is to provide means for protecting the crack or space between the door and door jamb, without creating an unsightly appearance, and to do so in a manner which is relatively inexpensive from a manufacturing and an installation point of view.

Briefly, in accordance with an aspect of the invention, these and other objects are accomplished by providing a bulletproof door and a door jamb construction which tend to prevent high energy shrapnel fragments from entering through the crack between the door and door jamb, and into the protected area behind the door.

A bulletproof door and door jamb construction includes a door jamb which includes a vertically extending opening therein in an area where bullet shrapnel fragments can pass freely therethrough into the hollow interior of the door jamb so that the spent fragments lose their energy and do not enter the protected area behind the door by passing through the crack or space between the door and door jamb.

BRIEF DESCRIPTION OF DRAWINGS

The above-mentioned and other objects and features of this invention, and the manner of attaining them will become apparent, and the invention itself will be best understood, by reference to the following description of an embodiment of the invention taken in conjunction with the accompanying drawings, wherein:

FIG. 1 shows a horizontal sectional view of a prior art bulletproof door for the purpose of explaining the problems all too frequently associated therewith;

FIG. 2 shows a horizontal sectional view of a shrapnel-proof door frame construction, which is made according to the present invention; and FIG. 3 shows a horizontal sectional view of another shrapnel-proof door frame construction, which is also constructed according to the present invention.

BEST MODE FOR CARRYING OUT THE INVENTION

Referring now to FIG. 1 of the drawings, there is shown a conventional bulletproof door and door jamb construction 10, which is like most doors, except that it is made from bulletproof specification material, for example, a specification is resist a high-powered army rifle (not shown). In the figure is seen a bulletproof in-swing door 26 and a hollow single-rabbet door jamb 22 of a door frame defining a door-frame opening, generally indicated at 27, opening through a vertical wall 20. In greater detail, the conventional wall 20 may be any suitable wall which requires a bulletproof door. The door jamb 22 has a vertically extending conventional door stop 24 formed therein to limit the swinging motion of the door 26. The door 26 swings on hinges (not shown) about a vertical axis to open in direction A out of the vertical plane of the door frame opening generally indicated at 27, into a protected area 29. The door 26 swings to close in a direction B to a position within the opening 27, as illustrated. When the door is closed, a crack or space 28 remains between the door 26 and the door jamb 22.

The door 26 and the door jamb 22 are constructed of bulletproof specification material, which means that they can not be penetrated by the particular kind of bullet which they are designed to stop. However, as shown in phantom lines at 30, the material may tend to impart a dish-shaped deformation at the point of impact by a bullet 32 discharged toward the threat side of the door 26. Upon impact with the door 26, the bullet 32 tends to give off shrapnel fragments which almost always tend to travel in a plane which is parallel to the door. See arrows 29. In some cases, the fragments may then enter the crack or gap 28 between the side edge of the door 26 and the door jamb 22. See arrows 31.

It has been found that the crack 28 acts as a guide for these fragments so that they tend to follow the path from C to D, thereby entering the protected area 29 as indicated. Thus, people or property positioned opposite the crack 28 at the protected side of the door 26 may be struck by the fragments.

Referring now to FIG. 2, there is shown a bulletproof door and door jamb construction 10A in accordance with the present invention. The construction 10A generally comprises a door jamb 22A of a single-rabbet door frame defining a vertical door opening generally indicated at 27A opening through a vertical wall (not shown). An in-swing door 26A is hung within the door opening 28A. The door jamb 22A and the door 26A are composed of suitable bulletproof specification materials.

According to one aspect of the invention, the door jamb 22A has an opening 34 extending along its vertical length. Thus, when a bullet 32A fragments, the shrapnel particles or fragments follow the path of travel indicated by the arrows extending from E to F. Because there is no continuous or imperforate surface at the door stop to guide the fragments, they fly through the opening 34 and spend their energy penetrating the door jamb and the wall material.

The object of the bulletproof door is to prevent penetration into the protected inside area behind the door. Therefore, it should be understood that it is irrelevant whether fragments fly off in directions other than the crack 28A.

Referring now to FIG. 3, there is shown a bulletproof door and door jamb constuction 10 having a door jamb 22B of a double-rabbet door frame defining a vertical door opening generally indicated at 27B, in a vertical wall (not shown). The door jamb 22B is composed of suitable bulletproof specification material. An outswing door 26B is composed of suitable bulletproof specification material and is hung within the door opening 27B.

The construction 10B is similar to the construction 10A, except that a bullet 32B enters a crack or space 36B in a direct and straight line, as indicated by the arrows, whereas in FIG. 2, the fragments must change their direction of travel to enter the protected area behind the door. Thus, in the construction 10B, a substantially greater energy of the bullet 32B must be absorbed.

The door jamb 22B includes an opening 40 extending the vertical height of the jamb. A cantilevered section 42 of a door jamb stop 43 absorbs the energy of the fragments or shrapnel by bending inwardly, as shown by the dashed lines at 44. The bending not only helps to absorb energy from the shrapnel, but the bent section 44 also forms a deflecting angle, relative to the direction of fragment travel, to direct the fragments into a space 46 defined partially by the stop 43 and a frame piece 50, which is welded to the opposite inside portion of the door jamb, at locations 52 and 54. The frame piece 50 forms an enclosure with sufficient strength of material to stop all fragments of the bullet.

Those who are skilled in the art will readily perceive how to modify the system within the teaching of the invention. For example, many different types and kinds of materials may be employed for the door and door jamb construction of the present invention. In the illustrated embodiments, the door jamb of the present invention is hollow and is shaped so as to have an integrally formed door stop. Therefore, the appended claims are to be construed to cover all equivalent structures which fall within the true scope and spirit of the invention.

I claim:

1. A bulletproof door and door jamb construction, comprising:

a door composed of a material having adequate strength to prevent penetration by a bullet fired from a specified gun; and a door frame defining a door opening, said frame being composed of a material having adequate strength to prevent penetration by a bullet fired from a specified gun, said frame including a door jamb having means defining an opening extending vertically for the entire height of said door jamb for receiving bullet fragments to divert them away from a path of travel into the space between said door and said door frame, said opening being suitably dimensioned to receive the bullet fragments, said opening being disposed on the threat side of the door in line with the plane of the door;

wherein said door jamb includes a hollow interior, said opening communicating with said hollow interior to permit the bullet fragments to be guided through said opening and into said hollow interior for causing them to lose their energy in a safe manner; and further including a generally C-shaped piece fixedly connected to the hollow inside of the door jamb opposite the door stop, said opening being positioned at the intersection of said door stop with the plane of the door jamb.

2. A bulletproof door jamb for use with a bulletproof door, comprising:

a door composed of a material having adequate strength to prevent penetration by a bullet fired from a specified gun; and a door frame defining a door opening, said frame being composed of a material having adequate strength to prevent penetration by a bullet fired from a specified gun, said frame including a door jamb having means defining an opening extending vertically for the entire height of said door jamb for receiving bullet fragments to divert them away from a path of travel into the space between said door and said door frame, said opening being suitably dimensioned to receive the bullet fragments, said opening being disposed on the threat side of the door in line with the plane of the door;

wherein said door jamb includes a hollow interior, said opening communicating with said hollow interior to permit the bullet fragments to be guided through said opening and into said hollow interior for causing them to lose their energy in a safe manner; and further including a generally C-shaped piece fixedly connected to the hollow inside of the door jamb opposite the door stop, said opening being positioned at the intersection of said door stop with the plane of the door jamb.

3. A bulletproof door and door jamb construction, comprising:

a door composed of a material having adequate strength to prevent penetration by a bullet fired from a specified gun;

a door frame defining a door opening, said frame being composed of a material having adequate strength to resist penetration by a bullet fired from a specified gun, said frame including a door jamb having a hollow interior and means defining an opening in communication with said hollow interior to permit the bullet fragments to be guided through said opening and into said hollow interior for causing them to lose their energy in a safe manner, said opening extending vertically for the entire height of said door jamb for receiving bullet fragments to divert them away from a path of travel into the space between said door and said door frame, said opening being suitably dimensioned to receive the bullet fragments, and said opening being disposed on the threat side of the door in line with the plane of the door.

4. A bulletproof door and door jamb construction, according to claim 3, wherein said door jamb includes a vertically extending door stop defining a hollow compartment and an opening in communication with said hollow compartment, said opening being disposed adjacent to said door stop on the threat side of the door.

5. A bulletproof door and door jamb construction, according to claim 4, further including a generally C-shaped piece fixedly connected to the door jam with the hollow interior of the door jamb opposite the door stop, said opening being positioned at the intersection of said door stop with the plane of the door jamb.

6. A bulletproof door jamb for use with a bulletproof door, comprising:

a door frame defining a door opening, said frame being composed of a material having adequate strength to resist penetration by a bullet fired from a specified gun, said frame including a door jamb having a hollow interior and means defining an opening in communication with said hollow interior to permit the bullet fragments to be guided through said opening and into said hollow interior for causing them to lose their energy in a safe manner, said opening extending vertically for the entire height of said door jamb for receiving bullet fragments to divert them away from a path of travel into the space between said door and said door frame, said opening being suitably dimensioned to receive the bullet fragments, and said opening being disposed on the threat side of the door in line with the plane of the door.

7. A bulletproof door jamb according to claim 6, wherein said door jamb includes a vertically extending door stop defining a hollow compartment and an opening in communication with said hollow compartment, said opening being disposed adjacent to said door stop on the threat side of the door.

8. A bulletproof door jamb according to claim 6, further including a generally C-shaped piece fixedly connected to the door jamb within the hollow interior of the door jamb opposite the door stop, said opening being positioned at the intersection of said door stop with the plane of the door jamb.

* * * * *